US008414179B2

(12) United States Patent
Schauerte et al.

(10) Patent No.: US 8,414,179 B2
(45) Date of Patent: Apr. 9, 2013

(54) APPARATUS FOR MIXING A POWDERY MEDIUM WITH A FLUID

(75) Inventors: Manfred Schauerte, Schmallenberg (DE); Markus Hamers, Lennestadt (DE); Meinolf Rameil, Lennestadt (DE)

(73) Assignee: Tracto-Technik GmbH & Co. KG, Lennestadt (DE)

( * ) Notice: Subject to any disclaimer, the term of this patent is extended or adjusted under 35 U.S.C. 154(b) by 169 days.

(21) Appl. No.: 12/908,188

(22) Filed: Oct. 20, 2010

(65) Prior Publication Data

US 2011/0255365 A1 Oct. 20, 2011

(30) Foreign Application Priority Data

Oct. 21, 2009 (DE) ..... 10 2009 050 177

(51) Int. Cl.
*B01F 15/02* (2006.01)
*B01F 7/08* (2006.01)

(52) U.S. Cl.
USPC ..... 366/50; 366/168.1; 366/172.1; 366/318

(58) Field of Classification Search ..... 366/9, 10, 366/12, 14–38, 156.1, 158.4, 167.1–183.1, 366/156.2, 158.5, 50, 318
See application file for complete search history.

(56) References Cited

U.S. PATENT DOCUMENTS

| | | | | |
|---|---|---|---|---|
| 1,731,953 | A * | 10/1929 | Thomson | 366/5 |
| 3,231,245 | A * | 1/1966 | Harvey | 366/28 |
| 7,575,071 | B2 | 8/2009 | Schauerte | |
| 2002/0125046 | A1 | 9/2002 | Schauerte | |
| 2008/0041449 | A1 | 2/2008 | Schauerte | |

FOREIGN PATENT DOCUMENTS

| | | | |
|---|---|---|---|
| CN | 101590391 | A | 2/2009 |
| DE | 199 18 775 | B4 | 4/2000 |
| GB | 924128 | A | 4/1963 |

* cited by examiner

*Primary Examiner* — Tony G Soohoo
*Assistant Examiner* — Anshu Bhatia
(74) *Attorney, Agent, or Firm* — Henry M. Feiereisen LLC

(57) ABSTRACT

An apparatus for mixing a powdery medium with a fluid includes a mixing vessel which can be filled with the fluid and which has a feed for the fluid, an inlet for the powdery medium and an outlet for the fluid mixed with the powdery medium, and at least one mixing screen which divides the mixing vessel into a first section which includes the feed and a second section which includes the inlet.

7 Claims, 1 Drawing Sheet

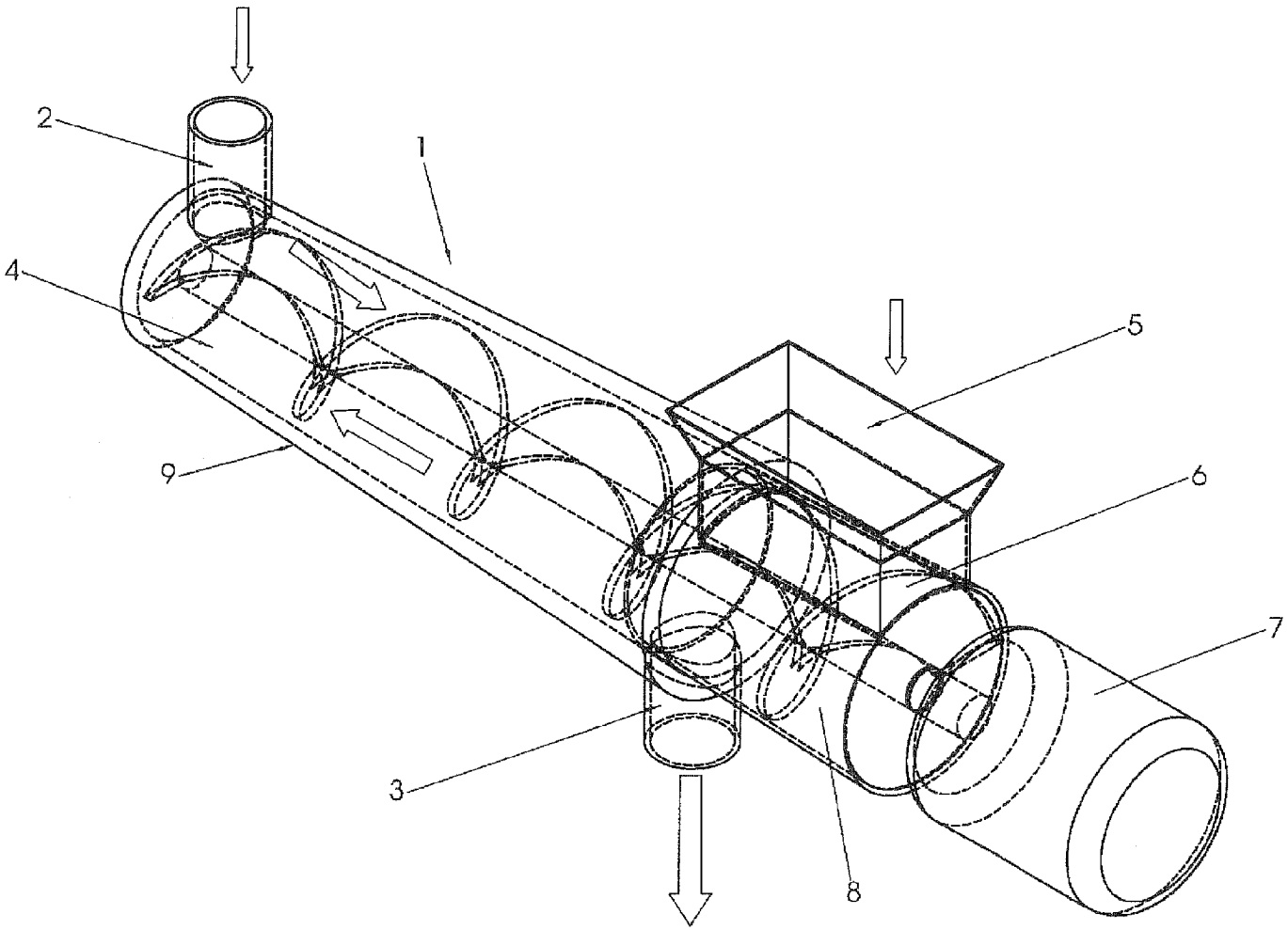
1
2
3
4
5
6
7
8
9

APPARATUS FOR MIXING A POWDERY MEDIUM WITH A FLUID

CROSS-REFERENCES TO RELATED APPLICATIONS

This application claims the priority of German Patent Application, Serial No. 10 2009 050 177.0, filed 21 Oct. 2009, pursuant to 35 U.S.C. 119(a)-(d), the content of which is incorporated herein by reference in its entirety as if fully set forth herein.

BACKGROUND OF THE INVENTION

The present invention relates to an apparatus for mixing a powdery medium with a fluid and to a mixing plant including such mixing apparatus.

The following discussion of related art is provided to assist the reader in understanding the advantages of the invention, and is not to be construed as an admission that this related art is prior art to this invention.

A drilling fluid is typically used for supporting the drill feed when constructing ground drill holes and in particular horizontal drill holes. The drilling fluid is used to soften the ground in advance of the drill head of the drilling apparatus in order to improve the cutting performance of the drill head. The drilling fluid can also be used to lubricate the drill head and the drill rods, which are rotatably driven in the drill hole, so as to reduce friction with the ground. In addition, the drilling fluid can be used to flush out the soil removed by the drill head through the annular gap between the drill rod and the wall of the drill hole or through an annular gap of dual drill rods.

The drilling fluid is typically a mixture of water and bentonite, and sometimes several additives. Bentonite is a mixture of different clay materials, with the largest component being montmorillonite (generally with a content of 60% to 80%). Additional accompanying materials may be quartz, mica, feldspar, pyrite and sometimes also calcite. Due to the montmorillonite content, bentonite has strong water absorption and swelling capability.

Water into which bentonite has been stirred can have thixotropic characteristics, so that it behaves like a fluid when in motion, but like a solid structure when at rest. Because of this behavior, a drilling fluid composed of water and bentonite can also be used for supporting the wall of the drill hole, thereby preventing a collapse.

The introduction of bentonite into water poses a particular challenge, because the bentonite has the tendency to lump together in contact with water. In some applications, the drilling fluid is stirred in large storage vessels with dynamic mixing devices and thereafter transported in batches to the construction site where the drilling fluid is to be used. However, mixing these batches is quite cumbersome. In addition, after the drill hole has been completed, the unused portion of the last batch must be disposed of, which is complex and expensive.

The disadvantage of batch-mixing of a drilling fluid can be eliminated by introducing the bentonite directly into the water in the region of a high-pressure pump, which is provided for transporting the drilling fluid through the drill rod to the drill head of a horizontal drilling apparatus, in order to take advantage of the turbulences produced in the water by the high-pressure pump for mixing the bentonite with the water. A swelling section can be added downstream of the high-pressure pump, where the bentonite-water-mixture is given time to swell before it is transported through the drill rod to the drill head.

It would therefore be desirable and advantageous to obviate prior art shortcomings by providing an improved apparatus for introducing a powdery medium into a fluid, or for mixing the powdery medium with the fluid, wherein problems caused by lumping of the powdery medium upon contact with the fluid can be reduced or even eliminated. It would also be desirable to provide a mixing plant for mixing a drilling fluid which employs this apparatus.

SUMMARY OF THE INVENTION

According to one aspect of the present invention, an apparatus for mixing a powdery medium with a fluid includes a mixing vessel constructed to be filled with the fluid, wherein the mixing vessel includes a feed for the fluid, an inlet for the powdery medium, an outlet for the fluid mixed with the powdery medium, and at least one mixing screen which divides the mixing vessel into a first section comprising the feed for the fluid and a second section comprising the inlet for the powdery medium.

According to another aspect of the invention, a method for mixing bentonite with an aqueous fluid in a mixing vessel having at least one mixing screen which divides the mixing vessel into a first section and a second section includes the steps of supplying the fluid through a feed into the first section of the mixing vessel, supplying the powdery medium through an inlet into the second section of the mixing vessel, and removing the fluid mixed with the powdery medium from the mixing vessel through an outlet.

In the apparatus of the invention, the powdery medium is pressed through the at least one mixing screen from one side, wherein the mixing screen is wetted by the fluid from the other side over the largest possible area, in order to attain thorough mixing of the fluid with the powdery medium.

In one embodiment, the mixing screen may be constructed in the shape of a cylinder, wherein the interior volume of the cylinder is connected with the inlet for the powdery medium. The interior volume of the cylindrical mixing screen thereby forms at least one section of the second part of the mixing chamber.

To ensure that the outer jacket of the cylindrical mixing screen is wetted by the fluid over the greatest possible area, the feed for the fluid may be integrated in the region of an end of the cylindrical mixing screen, whereas the outlet may be integrated in the mixing vessel in the region of the second end of the cylindrical mixing screen, so that the fluid flows from the feed to the outlet along preferably the entire outer surface of the cylindrical mixing screen.

To attain a desired mixing ratio of the fluid and the powdery medium, a conveying means may be provided which transports the powdery medium introduced into the mixing vessel through the feed towards the mixing screen and, depending on the situation, also presses the powdery medium through the mixing screen. The dosage of the powdery medium may also be adjusted commensurate with the transport capacity of the conveying means. To this end, a drive for the conveying means may include a controller to be used for varying the transport capacity of the conveying means. The controller may be operated manually, but may also be connected with a sensor which measures the mixing ratio of the fluid mixed with the powdery medium to automatically control the transport capacity based on the measured actual value and a comparison with the desired value.

The conveying means may preferably be a screw conveyor driven by an electric motor or another type of motor. Precisely regulated quantities of the powdery medium can then be supplied to the screen by continuously transporting defined quantities of the powdery medium with the screw conveyor. The use of a screw conveyor is particularly advantageous with a simultaneous continuous inflow of the fluid into the mixing vessel, as is the case, for example, with continuous mixing systems.

In another exemplary embodiment of the present invention, mixing of the powdery medium with the fluid may be improved with (additional) static or dynamic mixing elements. For example, one or more injector nozzles projecting into the mixing vessel may be provided, through which a pressurized gas may be introduced into the mixing vessel. The pressurized gas exiting from the injector nozzles into the mixing vessel can further mix the fluid and the particles of the powdery medium dispersed therein through turbulence, thereby further improving mixing.

Alternatively or in addition, a similar effect may be produced by introducing ultra-sound waves into the mixing vessel with an ultrasound generator, thereby further improving intermixing of the fluid with the powdery medium.

Advantageously, other mixing elements, such as diverter blades projecting into the mixing vessel, may also be employed.

Advantageously, an apparatus according to the invention may be used to introduce bentonite into an aqueous fluid and particularly into (clean) water.

A mixing plant according to the invention for mixing a drilling fluid includes the (mixing) apparatus according to the invention and a water supply connected with the feed of the apparatus, a bentonite supply connected with the inlet of the apparatus, and a pump connected with the outlet of the apparatus.

Preferably, the pump of the mixing plant according to the invention may be a high-pressure pump which enables construction of a continuous mixing plant, because a high-pressure pump is capable of producing a pressure sufficient for transporting the drilling fluid through a (hollow) drill rod of a drill string (drill rod and drill head).

BRIEF DESCRIPTION OF THE DRAWING

Other features and advantages of the present invention will be more readily apparent upon reading the following description of currently preferred exemplified embodiments of the invention with reference to the accompanying drawing, in which:

FIG. 1 shows a mixing apparatus according to the invention in an isometric view.

DETAILED DESCRIPTION OF PREFERRED EMBODIMENTS

The depicted embodiments are to be understood as illustrative of the invention and not as limiting in any way. It should also be understood that the figure is not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted.

In the context of the present invention, the term "mixing screen" refers to an element which spatially divides the mixing vessel into at least two sections and which has limited permeability for the powdery medium and/or the liquid.

The term "cylinder" or "cylindrical mixing screen" refers herein to a shape of the mixing screen where an outer jacket is at least partially formed by a screening layer. The cross-section of this outer jacket may be circular; however, other types of cross-sectional shapes, for example elliptical, triangular, rectangular, pentagonal, star-shaped and the like are also feasible. Both "cylinder" and "cylindrical mixing screens" are practicable, wherein the cross-section of the respective outer jacket either remains constant or changes over its/their length. For example, conical outer jackets also fall under this term.

Turning now to FIG. 1, there is shown a mixing apparatus according to the invention which includes a mixing vessel 1 surrounded by a conical housing section 9. A lateral feed 2 for a fluid, in the present example water, is integrated in the mixing vessel 1 on one end of the housing section 9. A corresponding lateral outlet 3 for the water mixed with the powdery medium, in the present case bentonite, is disposed on the opposite end.

The water mixed with the bentonite forms a drilling fluid which can be supplied, for example, to a high-pressure pump (at its suction or pressure side) of a continuous mixing plant of a drilling apparatus. The drilling fluid can be subjected in the high-pressure pump to such pressure that the drilling fluid is transported through a hollow drill rod to the drill head located at the front, exiting the drill head while still under a high-pressure.

The water is mixed with the bentonite as a result of the water flowing through the mixing vessel 1 from the feed 2 to the outlet 3, wherein the water wets the bentonite powder, which is pressed through small openings of a mixing screen 4, which is also conically shaped in conformance with the housing section 9 of the mixing vessel 1. The bentonite powder is hereby introduced into the mixing apparatus according to the invention through an inlet 5 and is transported by a screw conveyor 6, which is rotatably driven inside a screw conveyor housing 8 by an electric motor 7, to the interior volume formed by the conical mixing screen 4 and then pressed through the openings of the mixing screen 4.

The screw conveyor 6 extends through the mixing screen almost along the entire length of the mixing screen.

While the invention has been illustrated and described in connection with currently preferred embodiments shown and described in detail, it is not intended to be limited to the details shown since various modifications and structural changes may be made without departing in any way from the spirit and scope of the present invention. The embodiments were chosen and described in order to explain the principles of the invention and practical application to thereby enable a person skilled in the art to best utilize the invention and various embodiments with various modifications as are suited to the particular use contemplated.

What is claimed as new and desired to be protected by Letters Patent is set forth in the appended claims and includes equivalents of the elements recited therein:

What is claimed is:

1. An apparatus for mixing a powdery medium with a liquid medium, comprising:

a mixing vessel comprising a housing section having a first end with a feed for the liquid medium, the housing section further having a second end with an inlet for the powdery medium and an outlet for the liquid medium mixed with the powdery medium arranged proximate the second end, at least one mixing screen extending in a longitudinal direction from the first end to the second end of the housing section and dividing the mixing vessel into a first outer section comprising the feed and a second inner section comprising the inlet, and a screw conveyor disposed inside the second inner section for transporting the powdery medium from the second end toward the first end and pressing the powdery medium radially outwardly through the at least one mixing screen into the first outer section, wherein the powdery medium is entrained in and intermixed with the liquid medium flowing in the first outer section from the first end to the second end and discharged through the outlet.

2. The apparatus of claim 1, wherein the at least one mixing screen is constructed as a cylinder and has an interior volume connected with the inlet.

3. A mixing plant for mixing a powdery medium with a fluid, comprising:

an apparatus comprising a mixing vessel, the mixing vessel comprising:

a housing section having a first end with a feed for the fluid connected with a water supply, the housing section further having a second end with an inlet for the powdery medium connected with a bentonite supply, and an outlet for the fluid mixed with the powdery medium arranged proximate the second end and connected with a pump, at least one mixing screen extending in a longitudinal direction of the housing section and dividing the mixing vessel into a first outer section comprising the feed and a second inner section comprising the inlet, and a screw conveyor disposed inside the second inner section for transporting the powdery medium from the second end toward the first end and pressing the powdery medium radially outwardly through the at least one mixing screen into the first outer section, wherein the powdery medium is entrained in and intermixed with the liquid medium flowing in the first outer section from the first end to the second end and discharged through the outlet.

4. A method for mixing bentonite as a powdery medium with an aqueous fluid in a mixing vessel having a housing and at least one mixing screen which divides the mixing vessel into a first section and a second section, the method comprising the steps of:

supplying the fluid through a feed located at a first end of the housing into the first section of the mixing vessel, supplying the powdery medium through an inlet located at a second end of the housing opposite the first end into the second section of the mixing vessel, moving the powdery medium with a screw conveyor inside the second section from the second end to the first end, and forcing the powdery medium through the mixing screen into the first section, and removing the fluid mixed with the powdery medium from the first section of the mixing vessel through an outlet located proximate the second end.

5. The mixing plant of claim 3, wherein the housing section is a conical housing section.

6. The mixing plant of claim 3, wherein the pump is a high-pressure pump.

7. The apparatus of claim 1, wherein the housing section is a conical housing section.

* * * * *